US006105924A

United States Patent [19]

Carr

[11] Patent Number: 6,105,924

[45] Date of Patent: Aug. 22, 2000

[54] WEDGE APPARATUS AND MOLD

[76] Inventor: Dennis E. Carr, 153 Old Hedding Rd., #23, Epping, N.H. 03042

[21] Appl. No.: 09/015,990

[22] Filed: Jan. 30, 1998

[51] Int. Cl.[7] ..... B28B 7/30

[52] U.S. Cl. ..... 249/63; 249/152; 249/178; 249/180; 249/184; 249/205

[58] Field of Search ..... 249/63, 152, 178, 249/180, 205, 184

[56] References Cited

U.S. PATENT DOCUMENTS

| | | | |
|---|---|---|---|
| 4,437,642 | 3/1984 | Holt | 249/175 |
| 4,447,035 | 5/1984 | Ivey et al. | 249/194 |
| 4,519,570 | 5/1985 | Strickland et al. | 249/194 |
| 4,533,312 | 8/1985 | Holdt | 249/180 |
| 4,570,896 | 2/1986 | Strickland et al. | 249/27 |
| 5,230,907 | 7/1993 | Strickland | 425/107 |
| 5,230,908 | 7/1993 | Morgan | 425/117 |
| 5,524,861 | 6/1996 | Solomon | 249/27 |
| 5,755,982 | 5/1998 | Strickland et al. | 249/74 |
| 5,788,874 | 8/1998 | Tucker, Jr. | 249/180 |

*Primary Examiner*—Karen Aftergut
*Attorney, Agent, or Firm*—William B. Ritchie

[57] ABSTRACT

A wedge apparatus for use with molds and a mold utilizing at least one wedge apparatus. The wedge apparatus includes a pair of attachment portions, each having an attachment surface and a wedge surface, a wedge portion, and a shaft. The wedge portion is slidably attached to the attachment portions and has a center portion terminating in a pair of center edges disposed at opposite angles to the wedge edges such that the center surface and the wedge surfaces form a substantially continuous mold surface. The shaft is attached to the center portion and extends through an opening through a cross member to maintain the center edges of the wedge portion in alignment with the wedge edges of the attachment portions. The wedge apparatus is attached to a plurality of walls to form a portion of a mold, or a complete mold, and may be removed by moving the wedge portion in relation to the attachment portions such that a distance between the attachment portions is altered, separating the wedge apparatus, and the walls of the mold, from the molding material.

16 Claims, 9 Drawing Sheets

WEDGE APPARATUS AND MOLD

FIELD OF THE INVENTION

The present invention relates to the field of pre-cast concrete molds and, in particular, to collapsible cores for pre-cast concrete members, such as box culverts and the like.

BACKGROUND OF THE INVENTION

Hollow pre-cast concrete members are commonly used in a variety of applications such as water conduits, culverts and the like. These members are typically manufactured by disposing a collapsible central core a predetermined distance from a removable outer jacket, pouring concrete between the core and jacket, allowing the concrete to cure, collapsing and removing the core, and removing the jacket.

For many years, the collapsible cores utilized in the pre-cast process have utilized a plurality of pin and pivot hinges disposed along the sides of the core that allow the core to collapse inward and be removed once the concrete had set. This design facilitates removal of the cores by allowing them to collapse. However, the use of pin and pivot hinges with collapsible cores has inherent problems.

First, it is common for concrete to accidentally spill into the hinges, causing the hinges to temporarily bind. This binding can be remedied by exerting a shock force about the hinges with a hammer to break up the concrete and cause the hinges to move, but such force should not be applied until the concrete has been fully set for fear of ruining the concrete member. Second, the hinges are subjected to a harsh environment in which concrete, sand, small rocks, and the like, are prone to infiltrate the hinges. This infiltration can also cause the hinges to bind, creating the same problems as described above in reference to hardened concrete. In addition, infiltration of particulates will, over time, cause the hinges to wear, introducing a degree of play into the side walls that hinders proper alignment and causes unwanted seams to appear on the insides of the concrete member. A number of United States patents address some of the problems inherent in the current methods, but each has its own inherent drawbacks.

U.S. Pat. No. 4,969,626 titled "Adjustable Form For Casting Concrete Culverts" describes a form for casting three sided culverts that utilizes what is described as "unique expandable, multiple pin configuration" in place of traditional pin and pivot hinges. The pin configuration described in this patent is a triple pivot hinge utlizing two pivot members attached at one end to the walls of the form and at the other to a pair or additional pivot members by a pair of pins. The additional hinge members are attached together by a third pin and are held together by a fastener assembly. At the mating areas between the walls and members are mating splines that provide sealing against the concrete and prevent lines from appearing on the inside of the concrete element. This design overcomes one of the drawbacks inherent in traditional single pin designs as the removal of hinges from the seam areas minimizes the effects of play created by worn hinges. However, concrete and other particulates may still enter the hinges, causing the hinges to bind, necessitating the breaking techniques described above, and to eventually wear out. Thus, the hinge design of the U.S. Pat. No. 4,969,626 patent does not allow the core to be removed before the concrete is fully cured and is still prone to failure over time.

U.S. Pat. No. 4,790,508 titled "Concrete Casting Form Including Retractable Core" describes a method an apparatus for casting hollow concrete structures with a core section that does not include hinges. This is accomplished by mounting a continuous resilient core member on a hydraulic ram, disposing the core inside of retractable outer walls, coating the walls of the core with a release agent such as oil, pouring concrete between the core and walls, curing the concrete, activating the hydraulic ram to retract the core, retracting the walls and removing the concrete structure from the mold. This method overcomes many of the drawbacks of the current system as it does not utilize hinges that can wear or bind and thus does not require full curing of the concrete and does not produce unwanted seams in the cured concrete structure. Despite this fact, the design of the U.S. Pat. No. 4,790,508 patent has a number of drawbacks. First, this design is limited to cores of specific dimensions and cannot be varied to allow different hollow dimensions to be obtained. Second, the use of a hydraulic ram is not practical for use at a job site and thus this system is limited to use at dedicated facilities. Third, the continuous resilient nature of the core members requires that a release compound, such as oil, be used to prevent adhesion of the concrete to the walls of the core. Thus, if oil is not spread evenly across the entire outside surface of the core, the core will have a tendency to adhere to the concrete and be difficult to remove.

Still another release method and apparatus are described in U.S. Pat. NO. 4,673,159 titled "Molding Forms For Making Precast Portal Assembly Sections For Culverts". In this patent, the inner sections of a three sided culvert form are held together by a linkage system that allows the inner section of the form to be released when a shaft is rotated in a predetermined manner. Like the pivot and pin hinge designs, this design is prone to binding and degradation by concrete and other particulates and thus has the same inherent drawbacks.

A collapsible core section for use in pre-casting hollow concrete elements that will not bind, is not susceptible to wear and failure, does not produce elements having parting lines, may be used to form hollows of differing dimensions, and does not require a uniform application of mold release compounds to facilitate removal is not known in the art.

SUMMARY OF THE INVENTION

The present invention is a wedge apparatus for use with molds, a mold utilizing at least one wedge apparatus, and a method of producing a molded element utilizing the same.

In it most basic form, the wedge apparatus of the present invention comprises a pair of attachment portions, each having an attachment surface and a wedge surface, a wedge portion and a shaft. Each attachment surface is dimensioned for releasable attachment to the mold walls, and each of the wedge surfaces terminates in a wedge edge disposed at a predetermined angle such that the each wedge edge converges towards another wedge edge at one end of the wedge apparatus. The attachment portions are coupled together by a cross member having at least one opening. The wedge portion is slidably attached to the attachment portions and has a center surface terminating in a pair of center edges disposed at opposite angles to the wedge edges such that the center surface and the wedge surfaces form a substantially continuous mold surface. The shaft is attached to the center portion and extends through the opening of the cross member to maintain the center edges of the wedge portion in alignment with the wedge edges of the attachment portions. The wedge apparatus may be removed from a mold after a partial curing of a molding material by moving the wedge portion in relation to the attachment portions such that a distance between the attachment portions is altered, separating the wedge apparatus from the molding material.

In the preferred embodiment of the wedge apparatus, one wedge edge is disposed at a first predetermined angle and the other wedge edge is disposed at a second predetermined angle that is substantially equal and opposite to the first predetermined angle, and the shaft comprises a threaded portion having a plurality of threads that is rotatably attached to the wedge portion. A plurality of shafts and bushings are also utilized to maintain the edges of the wedge portion and of the attachment portions in alignment such that they continue to form a continuous surface when the wedge portion is moved. In this embodiment, the opening through the cross member is threaded with threads dimensioned to mate with the threads on the shaft allowing the wedge portion to be moved in relation to the attachment portions by rotating the shaft.

In other embodiments, a gear box and motor are attached to the shaft and act to move the wedge portion in the same manner as the preferred embodiment. In still other embodiments, a hydraulic cylinder is utilized, while still others utilize a lifting lug and a cable to move the wedge portion in relation to the attachment portions.

In its most basic form, a mold utilizing the wedges of the present apparatus comprises a first wall and a second wall, and at least a first wedge releasably attached to each of the walls. The mold of the present invention may be removed after a partial curing of a molding material by maintaining the attachment portions of each wedge apparatus in a substantially fixed position and moving each of the wedge portions such that a distance between the attachment surfaces of first wedge apparatus and the second wedge apparatus is altered, separating the core from the molding material. In some embodiments of the mold, an additional wedge apparatus and a plurality of rigid attachments are releasably attached to the walls.

The basic method of the present invention comprises the steps of providing at least one wedge apparatus comprising a wedge portion and a pair of attachment portions, aligning the wedge portions in predetermined relation relative to the attachment portions, attaching the attachment portions of the wedge apparatus to a plurality of walls to form a mold, disposing a molding material in a predetermined position relative to the mold, curing the molding material until the molded element will maintain a predetermined shape when the mold is removed, moving the wedge portions in relation to the attachment portions such that a distance between the walls of the mold are altered in a predetermined manner, and removing the mold from the molded element.

Therefore, it is an aspect of the invention to provide a removable mold that will not bind.

It is a further aspect of the invention to provide a removable mold that is not susceptible to wear and failure.

It is a further aspect of the invention to provide a removable mold that does not produce molded elements having parting lines.

It is a further aspect of the invention to provide a removable mold that may be used to form hollows of differing dimensions.

It is a further aspect of the invention to provide a removable mold that does not require a uniform application of mold release compounds to facilitate removal.

These aspects of the invention are not meant to be exclusive and other features, aspects, and advantages of the present invention will be readily apparent to those of ordinary skill in the art when read in conjunction with the following description, appended claims and accompanying drawings.

DETAILED DESCRIPTION OF THE DRAWINGS

The present invention comprises a wedge apparatus, a mold utilizing the wedge apparatus, and a method of using the mold. The use of the wedge apparatus of the present invention allows molds to be removed from molded elements before full curing of the molding material and prevents the binding and wear inherent in current systems.

Figure 1:
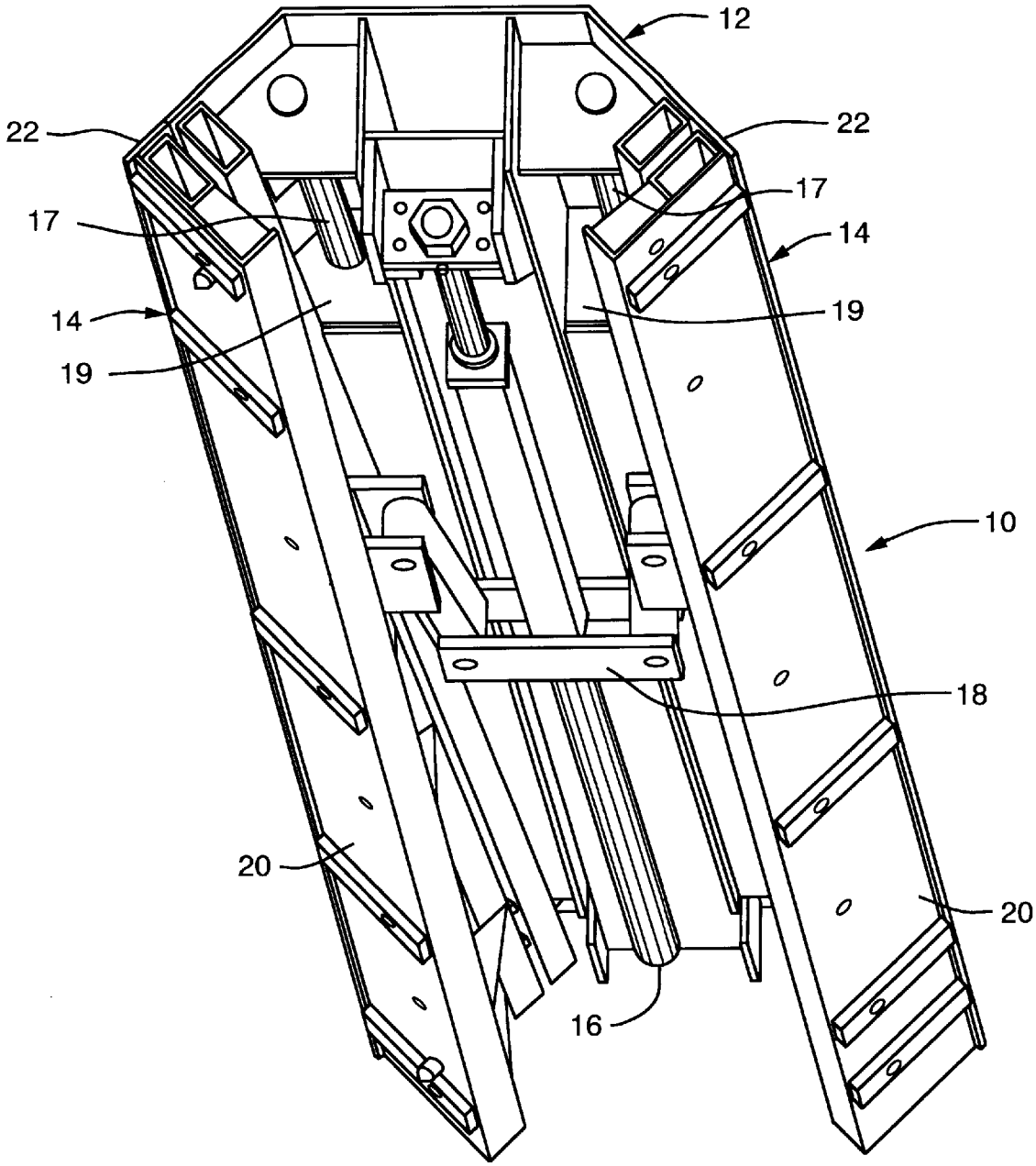
FIG. 1 is an isometric view of the preferred wedge apparatus of the present invention adapted for use with a core section of a hollow mold.
Figure 2:
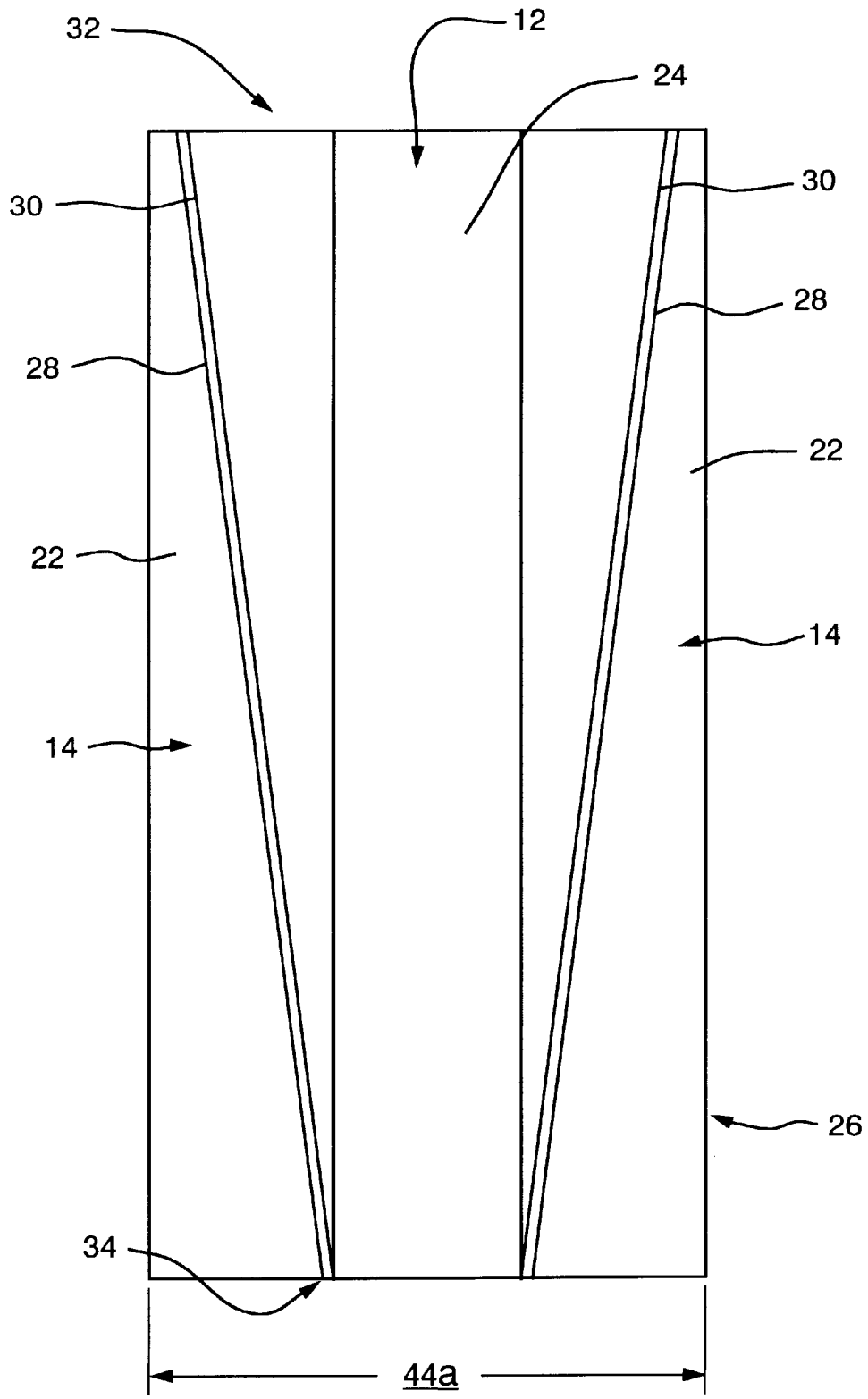
FIG. 2 is a front view of the mold surface of the preferred wedge apparatus of FIG. 1 with the wedge portion in an installed position.

Referring first to FIGS. 1 & 2, an isometric view of the preferred wedge apparatus 10 for use with a core of a hollow mold, and a front view of the mold surface 26 of the preferred wedge apparatus 10 of the present invention, are respectively shown. The wedge apparatus 10 comprises three basic elements; the wedge portion 12, the attachment portions 14, and the shaft 16 that aligns the wedge portion 12 with the attachment portions 14.

The attachment portions 14 are preferably mirror images of one another and are coupled together by a cross member 18 having an opening 40 through which the shaft 16 extends. Each attachment portion 14 has an attachment surface 20 that is adapted to attach to a mold wall (not shown) and a wedge surface 22 that mates at a wedge edge 28 with a center edge 30 of a corresponding center surface 24 of the wedge portion 12 to form a mold surface 26. Wedge portion 12 comprises a center surface 24 terminating in a pair of center edges 30 and is slidably attached to the attachment portions 14 such that it is free to move towards the top 32 and bottom 34 of the wedge apparatus 10. In the embodiment of FIG. 1, this slidability is accomplished by disposing a pair of alignment shafts 17 at the top end of the wedge portion 12 that silidably attach to a pair of bushings 19 rigidly attached to the attachment portions 14 and by disposing another pair of alignment shafts 17 at the bottom end of the attachment portion 14 that slidably attach to a pair of bushings 19 rigidly attached to the wedge portion 12. The alignment shafts 17 is disposed at predetermined angles, related to the angles formed at the wedge edges 28 of the attachment portions 14, that act to maintain the relationship between the center edges 30 of the wedge portion 12 and the wedge edges 28 of the attachment portions 14 when the wedge portion 12 is moved.

Figure 3:
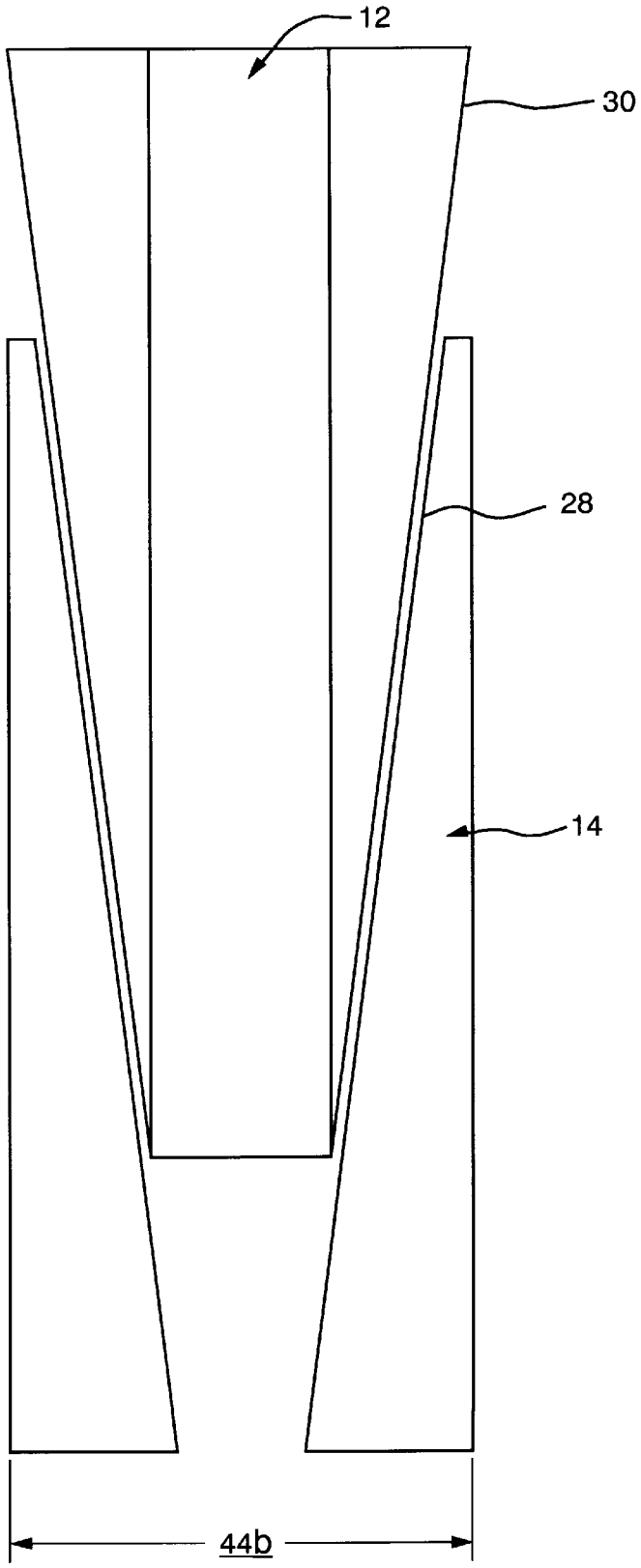
FIG. 3 is a front view of the mold surface of the preferred wedge apparatus of FIG. 1 with the wedge portion in position for removal.

When the wedge apparatus 10 is in its installed position, as shown in FIGS. 1 & 2, a distance 44*a* between the attachment surfaces 20 of the attachment portions 14 is at its predetermined maximum. As shown in FIG. 3, when the wedge portion 12 is raised relative to the attachment portions 14 so that the mold core may be removed, the distance 44*b* between the attachment portions 14 is decreased. This decrease in distance from 44*a* to 44*b* causes the core to essentially collapse inward and allows the core to be removed. It should be noted, however, that the wedge apparatus 10 of the present invention may also be adapted for use with an outer jacket for a mold by altering the angles formed along wedge edges 28 and center edges 30 so that the dimension 44 between attachment surfaces increases when the wedge portion 12 is moved.

In the preferred embodiment, shown in FIG. 1, the wedge portion 12 is rotatably attached to the shaft 16 and the shaft 16 includes a threaded portion 36 having a plurality of threads 38 that are dimensioned to mate with mating threads 42 disposed within the opening 40 through cross member 18. In this embodiment, the wedge portion 12 is moved in relation to the attachment portions 14 by rotating shaft 16, causing the threads 38 to bear on the mating threads 42 of opening 40. However, as shown in FIGS. 4–6, alternative embodiments of the wedge assembly include different means for moving the wedge portion 12 in relation to the attachment portion.

Figure 4:
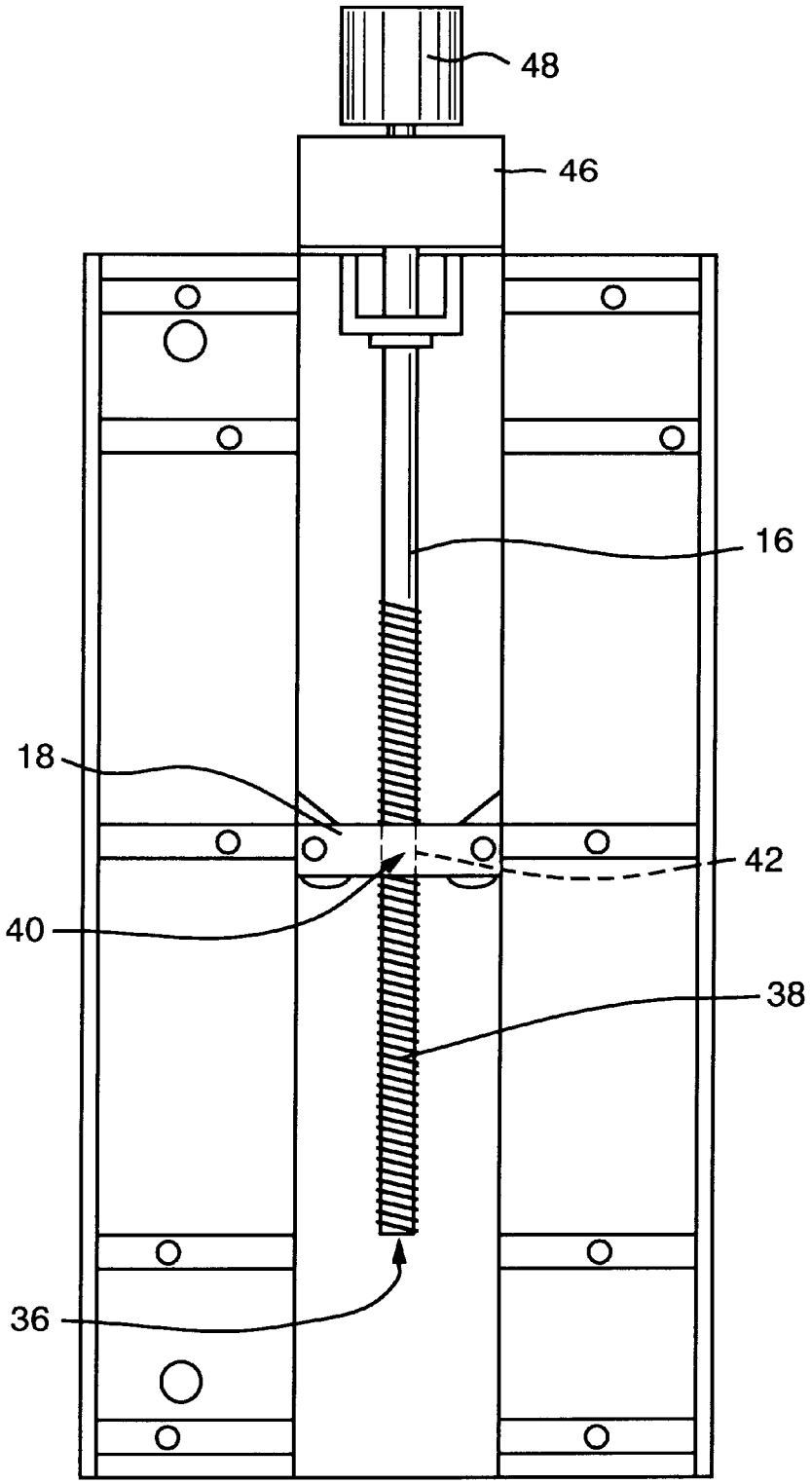
FIG. 4 is a back view of an alternate embodiment of the wedge apparatus showing the threaded shaft, gear box and motor.

FIG. 4 shows an alternate embodiment of the wedge apparatus 10 utilizing the threaded shaft 16 rotatably attached to the wedge portion 12 of FIG. 1, but further comprising a gear box 46 and a motor 48. In this embodiment, gear box 46 is attached to shaft 16 and is powered by motor 48. In operation, the wedge portion 12 of this embodiment is moved by transferring power from the motor 48 through the gear box 46 to the shaft 16, which acts to move the wedge portion 12 in the same manner as described with reference to FIG. 1.

Figure 5:
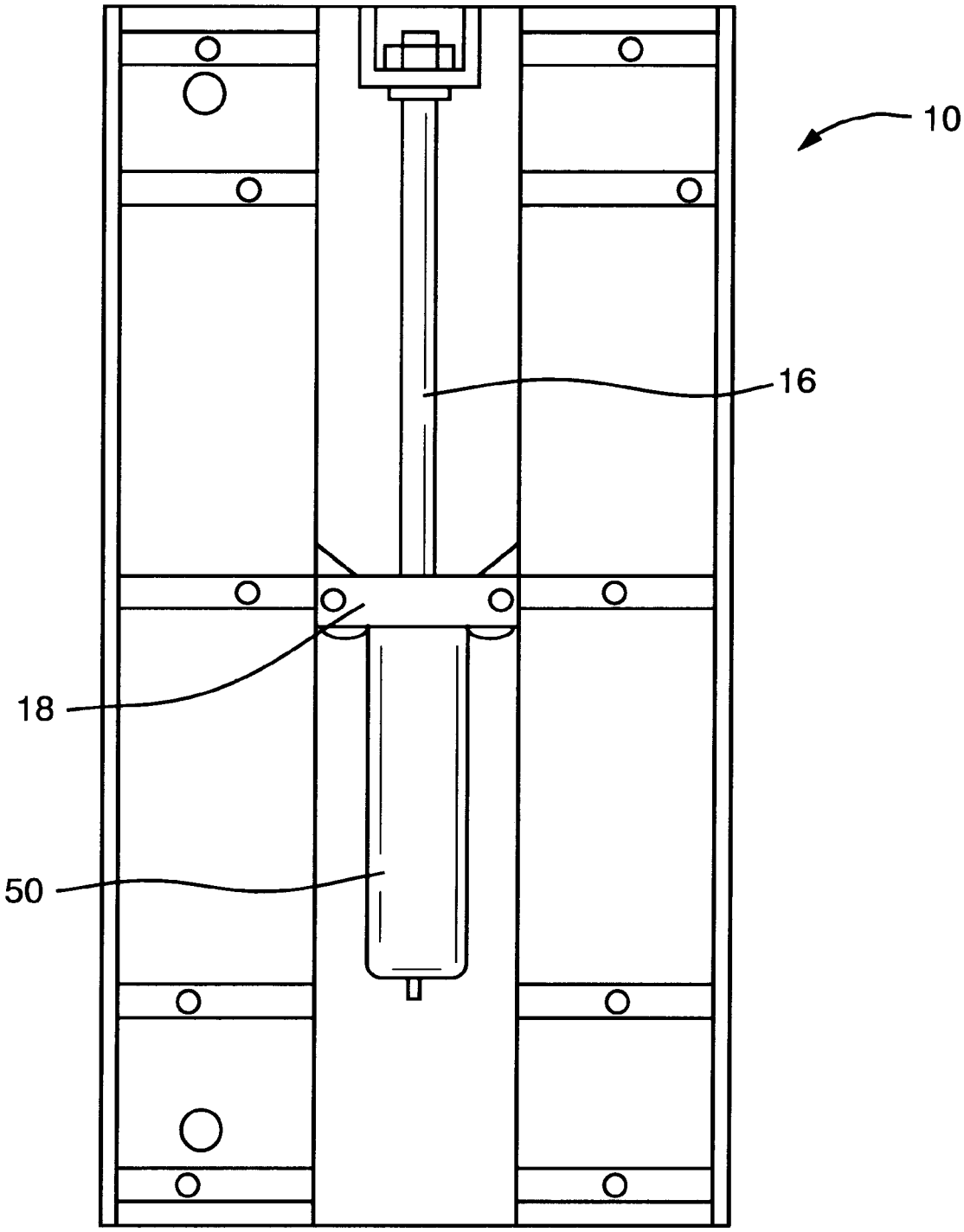
FIG. 5 is a back view of an alternate embodiment of the wedge apparatus showing a smooth shaft utilized as a piston with a hydraulic cylinder.

FIG. 5 shows another embodiment of the wedge apparatus 10 in which shaft 16 is not threaded, but is a smooth piston slidably attached to a hydraulic cylinder 50 that is rigidly mounted to the cross member 18. In this embodiment, the wedge portion 12 is moved by pumping a working fluid into hydraulic cylinder 50, effectively displacing shaft 16 upward, or by removing fluid from the hydraulic cylinder 50 and allowing gravity to move wedge portion 12 downward.

Figure 6:
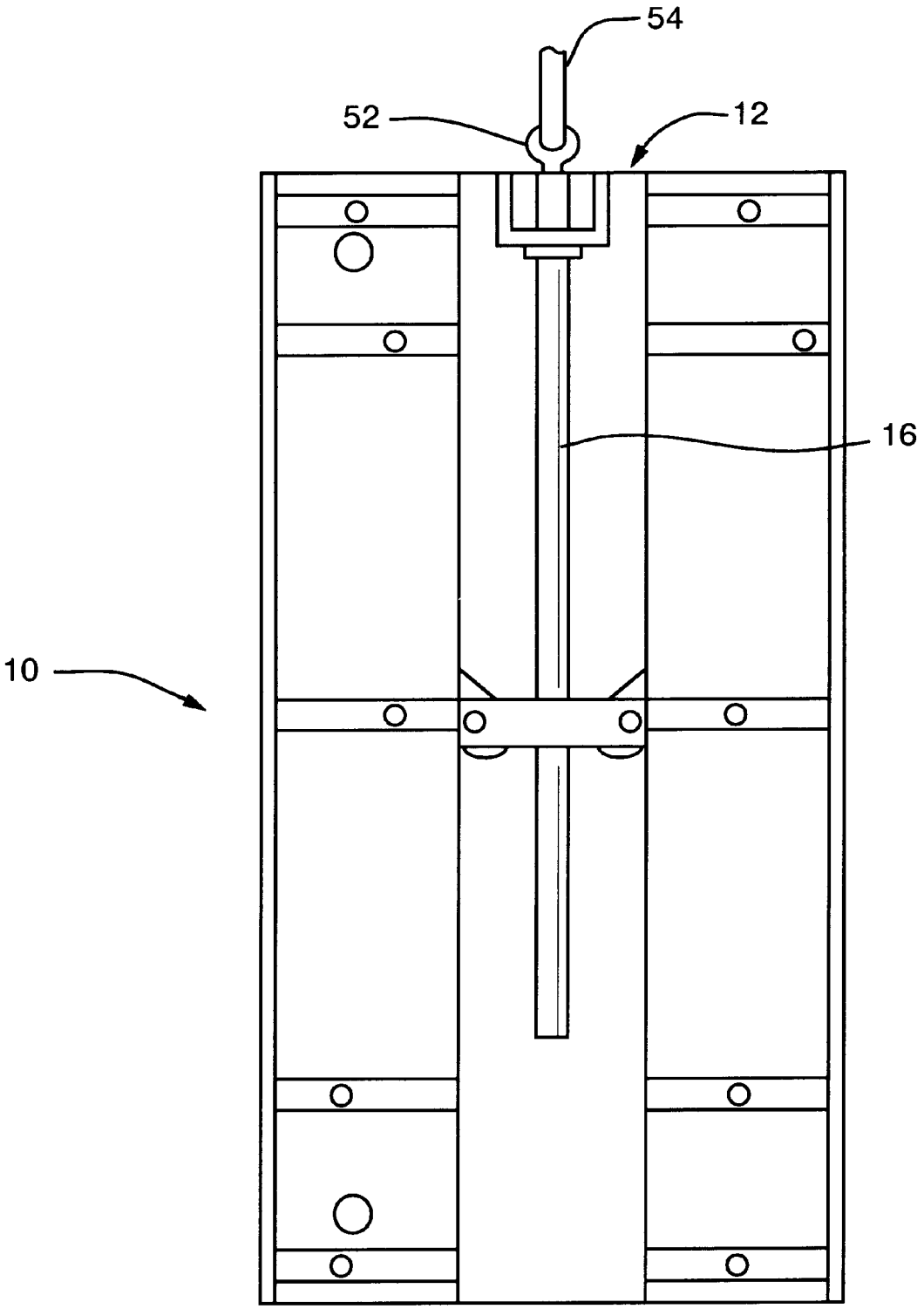
FIG. 6 is a back view of an alternate embodiment of the wedge apparatus having a smooth shaft, a lifting lug and a cable.

FIG. 6 shows yet another embodiment of the wedge apparatus 10 in which shaft 16 is used only as a guide for wedge portion 12. In this embodiment, at least one lifting lug 52 is attached to the top of wedge portion 12 and the wedge portion 12 is lifted by attaching a cable 54 to the lifting lug 52 and moving the cable 54 upward by art recognized means such as cranes, "come-alongs", winches, and the like.

Figure 7:
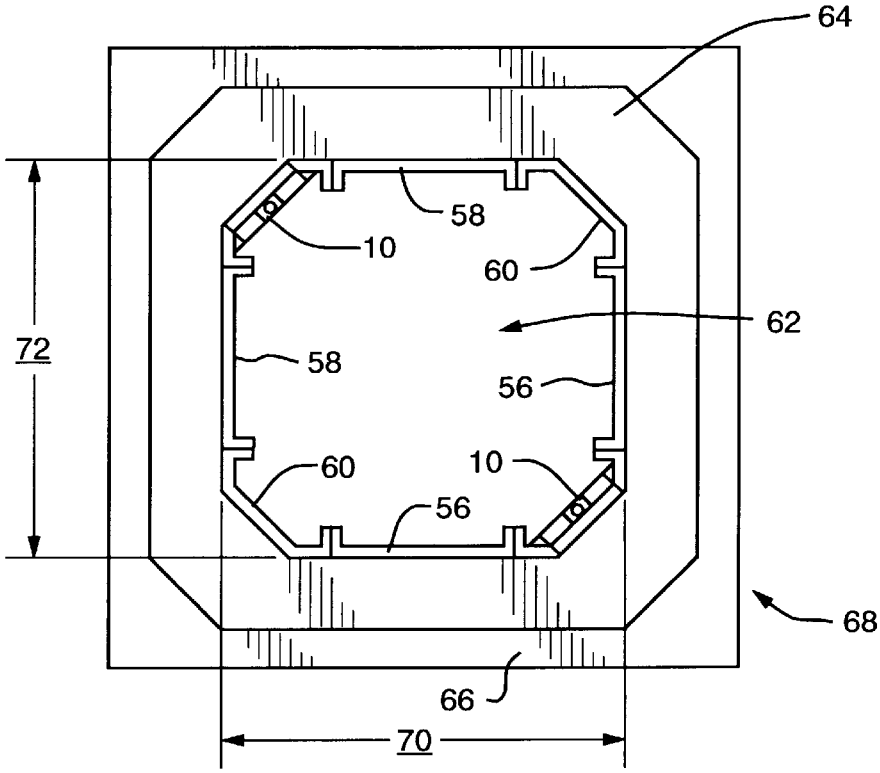
FIG. 7 is a top view of a square core mold of the present invention, utilizing a pair of rigid attachments, in an installed position.
Figure 8:
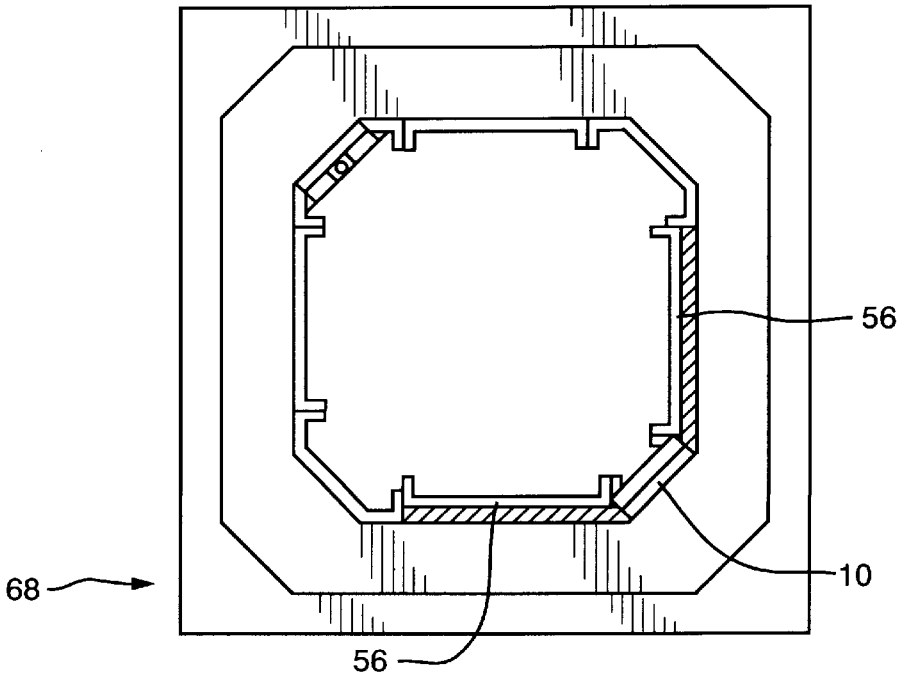
FIG. 8 is a top view of the square core mold of FIG. 7 in a position for removal.

Referring now to FIGS. 7 and 8, top views of a rectangular embodiment of a mold 68 utilizing two of the wedge apparatus 10 of the present invention are shown. As shown in FIG. 7, a first wedge apparatus 10 and a second apparatus 10 are removably attached to a pair of first walls 56 and a pair of second walls 58 respectively. In this embodiment, the walls 56, 58 are also removably attached to rigid attachments 60 that serve as corner sections opposite the wedge apparatus 10. When attached together, the two wedge apparatus 10, two rigid attachments 60 and four walls 56, 58 form an inner mold, or "core" 62, of a hollow box culvert mold. Adjacent the core 62 is a space 64 of predetermined, and preferably equal, cross section and an outer jacket 66 that, like the core 62 is removable once a molding material disposed within the space 64 is cured.

Molded elements, such as the box culverts formed by the mold 68 of FIGS. 7 & 8, may be manufactured by manipulating the mold 68 in the following manner. First, the first wedge apparatus 10 and second wedge apparatus 10 are attached to the walls 56, 58 and the tops of the wedge portions 12 are aligned with the top ends 32 of the wedge apparatus 10 such that the distance between the attachment surfaces is maximized. Next, the mold is secured by attaching the walls 56, 58 to the rigid attachments 60, forming a rigid core 62 of predetermined length 70 and width 72. A molding material, such as concrete, is then disposed in the space 64 between the core 62 and outer jacket 66 and is allowed to cure. However, the present invention eliminates the need to fully cure the molding material prior to removal of the core 62, but rather the molding material need only be cured until the molded element will maintain a predetermined shape when the mold is removed. Once the molded element is sufficiently cured, the walls 56, 58 are each detached from the rigid attachments 60. The wedge portion of the first wedge apparatus 10 is then moved upward with relation to the attachment portions causing the attachment portions, and the walls 56 to which they are attached, to move inward, as shown in FIG. 8. The first wedge apparatus 10 and walls 56 are then removed and the step is repeated for the second wedge apparatus 10 and walls 58.

Figure 9:
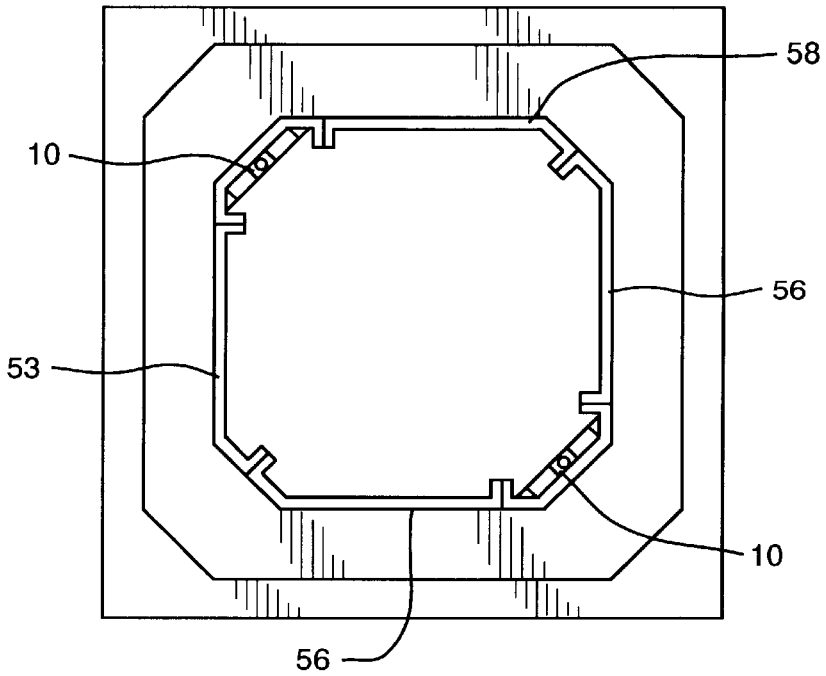
FIG. 9 is a top view of a square core mold of the present invention in which rigid attachments have been eliminated.

In other embodiments, such as the embodiment of FIG. 9, rigid attachments 60 are eliminated and walls 56, 58 are dimensioned to be removably attached to one another at a first end and to an attachment surface of a wedge apparatus at a second end. In this embodiment, the walls 56, 58 are removed from one another before the wedge apparatus 10 are manipulated.

Figure 10:
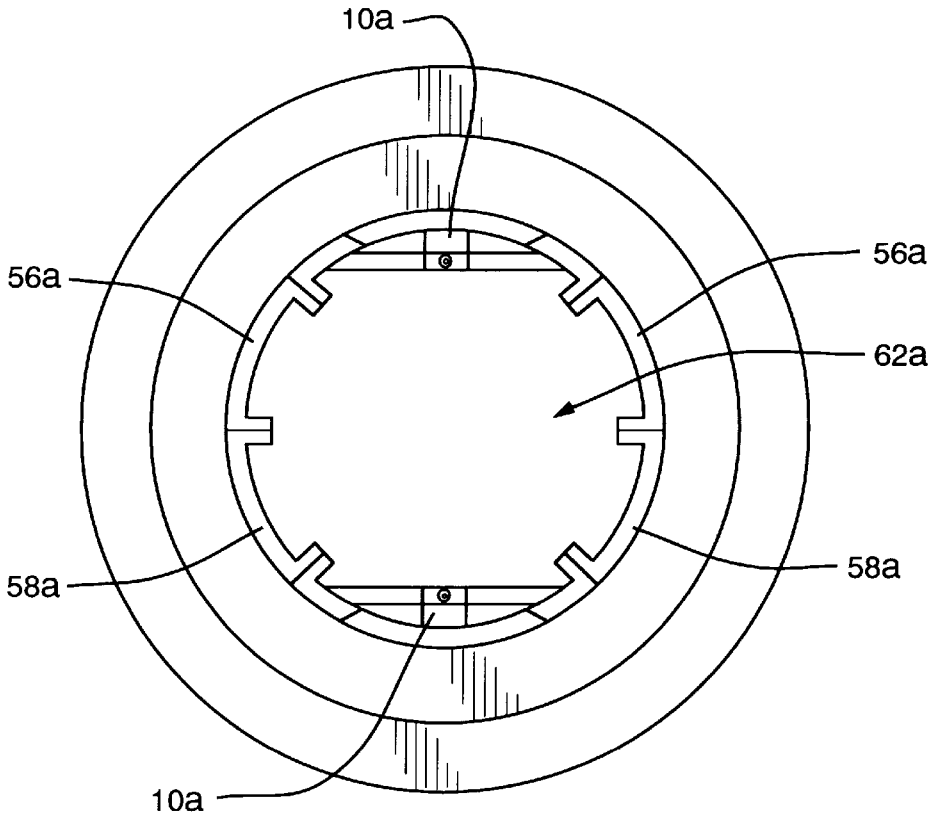
FIG. 10 is a top view of a round core mold of the present invention.

Though described with reference to square cores for box culvert molds, the present invention is adapted for use with molds of other shapes. One such alternate embodiment, forming a round hollow in a molded element, is shown in FIG. 10. This embodiment utilizes two rounded wedge apparatus 10*a*, each attached to two rounded walls 56*a*, 58*a* that are removably attached to one another at a central point. In this embodiment, the walls 56*a*, 58*a* are removed from one another after sufficient curing of the molded element and the wedge apparatus 10*a* are manipulated in a manner similar to those described above allowing the round core 62*a* to be removed in two pieces.

Figure 11:
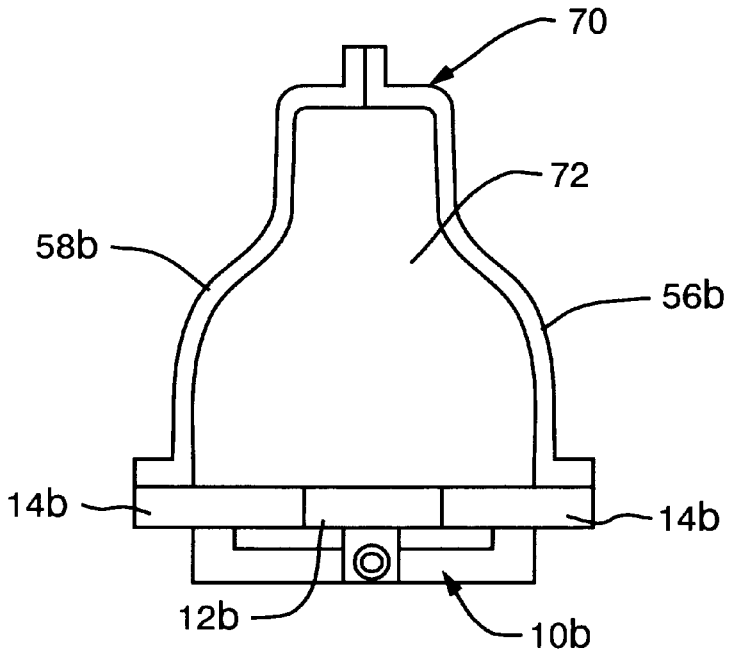
FIG. 11 is a top view of a mold of the present invention, adapted for use with solid articles, in an installed position.
Figure 12:
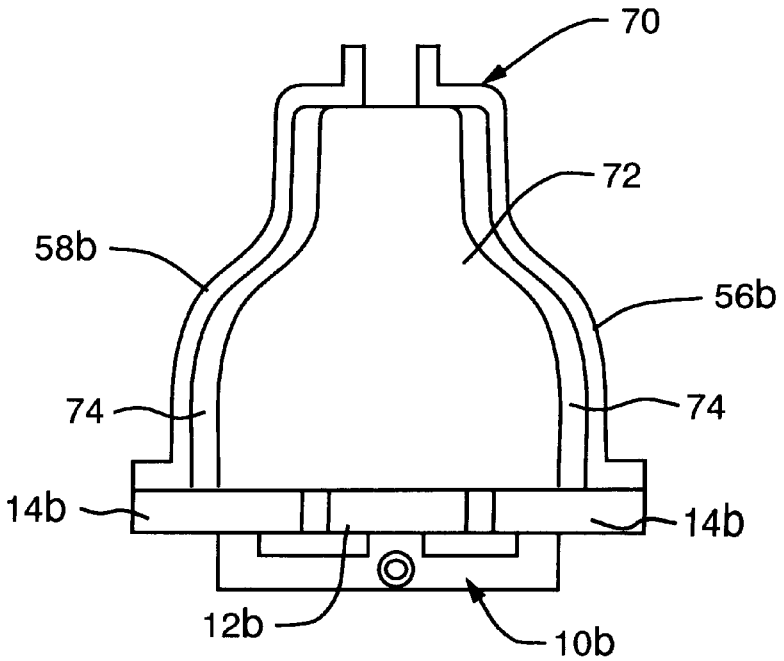
FIG. 12 is a top view of the mold of FIG. 11 in position for removal.

As noted above, the present invention is also adapted for use as an outer jacket for a hollow mold or as complete mold for solid molded elements. FIGS. 11 & 12 show the present invention utilized as a complete mold 70 in the manufacture of concrete highway barriers. In this embodiment, a single wedge apparatus 10*b* is adapted to attach to two side walls 56*b*, 58*b* dimensioned to provide an inner cavity in the desired shape of the molded element 72, here a highway barrier. In operation, the molding material, here concrete, is poured within the cavity and sufficiently cured, the side walls 56*b*, 58*b* are unattached from one another and the wedge portion 12*b* of the wedge apparatus 10*b* is moved in relation to the attachment portions 14*b* causing the distance between attachment portions to increase, creating a clearance 74 between the mold 70 and molded element 72 and allowing the mold 70 to be removed from the molded element 72.

Although the present invention has been described in considerable detail with reference to certain preferred versions thereof, other versions would be readily apparent to those of ordinary skill in the art. Therefore, the spirit and scope of the appended claims should not be limited to the description of the preferred versions contained herein.

What is claimed is:

1. A wedge apparatus, releasably attachable to a pair of walls of a mold, said wedge apparatus having a top end and a bottom end and comprising:

a pair of attachment portions, each having an attachment surface and a wedge surface, wherein each attachment surface is dimensioned for releasable attachment to one of said walls, wherein each of said wedge surfaces terminates in a wedge edge disposed at a predetermined angle such that said each wedge edge converges towards another wedge edge at one end of said wedge apparatus, and wherein said pair of attachment portions are coupled together by a cross member having at least one opening;

a wedge portion slidably attached to said attachment portions such that said wedge portion is movable towards said top end and said bottom end of said wedge apparatus, said wedge portion having a center surface terminating in a pair of center edges, said center edges being disposed at opposite angles to said predetermined angles of said wedge edges such that said center surface and said wedge surfaces form a substantially continuous mold surface; and a shaft attached to said wedge portion and extending through said opening of said cross member between said attachment portions such that said center edges of said wedge portion are maintained in alignment with said wedge edges of said attachment portions, and such that a movement of said shaft causes a corresponding movement of said wedge portion relative to said attachment portions;

wherein each of said attachment portions further comprises at least one alignment shaft, wherein said wedge portion further comprises at least two bushings, each of said bushings being slidably attached to one of said alignment shafts, and wherein each of said alignment shafts is disposed in predetermined relation to each of said wedge edges such that said mold surface remains substantially continuous when said wedge portion is moved towards said top end and said bottom end of said wedge apparatus; and wherein said wedge apparatus is removed from a mold after a partial curing of a molding material by moving said wedge portion in relation to said attachment portions such that a distance between said attachment portions is altered and such that a bond between said molding material and each of said wedge portion and said attachment portions is broken.

2. The wedge apparatus as claimed in claim 1 wherein each of said attachment surfaces are disposed at a substantially ninety degree angle from the other of said attachment surfaces.

3. The wedge apparatus as claimed in claim 1 wherein one of said wedge edges are disposed at a first predetermined angle and the other of said wedges is disposed at a second predetermined angle that is substantially equal to a sum of said first predetermined angle plus one hundred and eighty degrees.

4. The wedge apparatus as claimed in claim 1 wherein said shaft comprises a threaded portion having a plurality of threads and is rotatably attached to said wedge portion, wherein said opening through said cross member is threaded with threads dimensioned to mate with said plurality of threads, and wherein said wedge portion is moved toward said top end by rotating said shaft in a first direction and is moved toward said bottom end by rotating said shaft in a second direction said second direction being opposite to said first direction.

5. The wedge apparatus as claimed in claim 4, further comprising:

a gear box attached to said shaft; and a motor attached to said gear box;

wherein said shaft is rotated by transferring a rotational force from said motor to said gear box.

6. The wedge apparatus as claimed in claim 1, further comprising a hydraulic cylinder attached to said shaft and wherein said wedge portion is moved toward said top end by actuating said hydraulic cylinder.

7. The wedge apparatus as claimed in claim 1, further comprising at least one lifting lug attached to said wedge portion and wherein said wedge portion is moved toward said top end by attaching a cable to said lifting lug and exerting an upward force on said cable.

8. The wedge apparatus as claimed in claim 1 wherein said wedge edges converge at said bottom end and wherein said dimension between said attachment surfaces is decreased when said wedge portion is moved towards said top end of said wedge apparatus.

9. A mold comprising:

a first wall;

a second wall; and a wedge apparatus attached to said first wall and said second wall, said wedge apparatus having a top end and a bottom end and comprising;

a pair of attachment portions, each having an attachment surface and a wedge surface, wherein each attachment surface is dimensioned for releasable attachment to one of said first wall and said second wall, wherein each of said wedge surfaces terminates in a wedge edge disposed at a predetermined angle such that said each wedge edge converges towards another wedge edge at one end of said wedge apparatus, and wherein said pair of attachment portions are coupled together by a cross member having at least one opening;

a wedge portion slidably attached to said attachment portions such that said wedge portion is movable towards said top end and said bottom end of said wedge apparatus, said wedge portion having a center surface terminating in a pair of center edges, said center edges being disposed at opposite angles to said predetermined angles of said wedge edges such that said center surface and said wedge surfaces form a substantially continuous mold surface; and a shaft attached to said wedge portion and extending through said opening of said cross member between said attachment portions such that said center edges of said wedge portion are maintained in alignment with said wedge edges of said attachment portions, and such that a movement of said shaft causes a corresponding movement of said wedge portion relative to said attachment portions;

wherein each of said attachment portions further comprises at least one alignment shaft, wherein said wedge portion further comprises at least two bushings, each of said bushings being slidably attached to one of said alignment shafts, and wherein each of said alignment shafts is disposed in predetermined relation to each of said wedge edges such that said mold surface remains substantially continuous when said wedge portion is moved towards said top end and said bottom end of said wedge apparatus; and wherein said mold is removed from a molding material by moving said wedge portions towards one of said top end and said bottom end of said wedge apparatus such that a distance between said attachment surfaces of wedge apparatus is altered and such that a bond between said molding material and each of said wedge apparatus, said first wall and said second wall is broken.

10. The mold as claimed in claim 9 further comprising at least one rigid attachment and wherein said first walls and said second wall are releasably attached to said at least one rigid attachment.

11. The mold as claimed in claim 9 wherein said shaft of said wedge apparatus comprises a threaded portion having a plurality of threads and is rotatably attached to said wedge portion, wherein said opening through said cross member is threaded with threads dimensioned to mate with said plurality of threads of said shaft, and wherein said wedge portion is moved toward said top end by rotating said shaft in a first direction and is moved toward said bottom end by rotating said shaft in a second direction, said second direction being opposite to said first direction.

12. The mold as claimed in claim 11, further comprising:

a gear box attached to each of said shafts; and a motor attached to each of said gear boxes;

wherein said each shaft is rotated by transferring a rotational force from each motor to each gear box.

13. The mold as claimed in claim 9, further comprising a hydraulic cylinder attached to said shafts and wherein said wedge portions is moved toward said top end by actuating each said hydraulic cylinder.

14. The mold as claimed in claim 9, further comprising at least one lifting lug attached to said wedge portion and wherein said wedge portion is moved toward said top end by attaching a cable to each of said lifting lugs and exerting an upward force on said cable.

15. The mold as claimed in claim 9 further comprising;

a third wall having a pair of ends;

a fourth wall having a pair of ends;

a second wedge apparatus attached to one end of said third wall and one end of said fourth wall;

a first rigid attachment releasably attached to said first wall and said third wall; and a second rigid attachment releasable attached to said second wall and said fourth wall;

wherein said mold is a box culvert mold and wherein said first wedge apparatus is disposed in opposite relation to said second wedge apparatus and said first rigid attachment is disposed in opposite relation to said second rigid attachment to form a substantially square core.

16. The mold as claimed in claim 9 further comprising:

a third wall having a pair of ends, wherein one of said ends is attached to said first wall;

a fourth wall having a pair of ends, wherein one of said ends is attached to said second wall;

a second wedge apparatus attached to another of said ends of said third wall and another of said ends of said fourth wall;

wherein each of said center surfaces of said first wedge apparatus and said second wedge apparatus are curved, wherein said first wedge apparatus is disposed in opposite relation to said second apparatus, and wherein said first and second wedge apparatus and said first, second, third and fourth walls are dimensioned for assembly into a round core.

* * * * *